US008153964B2

(12) United States Patent
Chen et al.

(10) Patent No.: US 8,153,964 B2
(45) Date of Patent: Apr. 10, 2012

(54) ULTRASOUND IONIZATION MASS SPECTROMETER

(75) Inventors: Chung-Hsuan Chen, Taipei (TW); Chen-I Wu, Lexington, KY (US)

(73) Assignee: Academia Sinica, Taipei (TW)

( * ) Notice: Subject to any disclaimer, the term of this patent is extended or adjusted under 35 U.S.C. 154(b) by 333 days.

(21) Appl. No.: 12/457,064

(22) Filed: May 29, 2009

(65) Prior Publication Data

US 2010/0301199 A1 Dec. 2, 2010

(51) Int. Cl.
*H01J 49/26* (2006.01)

(52) U.S. Cl. ..... 250/288; 250/281; 250/282

(58) Field of Classification Search ..... 250/288, 250/281, 282, 423 R, 424
See application file for complete search history.

(56) References Cited

U.S. PATENT DOCUMENTS

| | | | | |
|---|---|---|---|---|
| 5,572,022 | A | 11/1996 | Schwartz | |
| 5,591,969 | A | 1/1997 | Park et al. | |
| 6,262,638 | B1 | 7/2001 | Scherer | |
| 6,646,256 | B2 | 11/2003 | Gourley et al. | |
| 6,906,320 | B2 | 6/2005 | Sachs et al. | |
| 7,084,396 | B2 | 8/2006 | Schneider | |
| 7,161,147 | B1 | 1/2007 | Chang et al. | |
| 7,329,866 | B2 | 2/2008 | Wang | |
| 7,465,920 | B2 * | 12/2008 | Hiraoka | 250/288 |
| 7,645,987 | B2 * | 1/2010 | Chang et al. | 250/288 |
| 2003/0122070 | A1 | 7/2003 | Chang et al. | |
| 2005/0153341 | A1 | 7/2005 | Alexander | |
| 2006/0284074 | A1 | 12/2006 | Chang et al. | |
| 2007/0131871 | A1 | 6/2007 | Chang et al. | |
| 2007/0272852 | A1 | 11/2007 | Miller | |
| 2008/0149821 | A1 | 6/2008 | Senko | |
| 2009/0189069 | A1 | 7/2009 | Chen et al. | |
| 2010/0012830 | A1 * | 1/2010 | Cristoni | 250/282 |

FOREIGN PATENT DOCUMENTS

WO WO2008/042949 A2 4/2008

OTHER PUBLICATIONS

Qin, Anal Chem 1996 vol. 68, pp. 2108-2112.
NASA's Jet Propulsion Laboratory, "Induction Charge Detector With Multiple Sensing Stages" (Jan. 1, 2008).
A. Hirabayashi, "Sonic Spray Ionization and Ion Formation Processes," J. Mass Spectrom. Soc. Jpn., 47:289-296 (1999).
A. Hirabayashi et al., "Sonic Spray Mass Spectrometry," Anal. Chem., 67:2878-2882 (1995).
A. Hirabayashi et al., "Multiply-charged Ion Formation by Sonic Spray," Rapid Comm. Mass Spectrom., 10:1703-1705 (1996).
A. L. Klibanov, "Targeted delivery of gas-filled microspheres, contrast agents for ultrasound imaging," Adv. Drug Deliv. Rev., 37:139-157 (1999).
A. M. Takalkar et al., "Binding and detachment dynamics of microbubbles targeted to P-selectin under controlled shear flow," J. Contr. Release, 96:473-482 (2004).

(Continued)

*Primary Examiner* — Kiet T Nguyen
(74) *Attorney, Agent, or Firm* — Eckman Basu LLP

(57) ABSTRACT

Methods and systems for ultrasound ionization mass spectrometry are provided. Analytes in a sample are ionized by subjecting them to ultrasound, facilitating their analysis by mass spectrometry. With these methods and systems, soft ionization of large analytes, including biological macromolecules and nanoparticles, can be achieved. Ionization efficiency can be improved by addition of chemicals such as, for example, organic solvents or acids to the sample.

26 Claims, 4 Drawing Sheets

OTHER PUBLICATIONS

M. Mecozzi et al., "Ultrasound extraction and thin layer chromatography-flame ionization detection analysis of the lipid fraction in marine mucilage samples," J. Chromatography, 963:363-373 (2002).
B. Akin et al., "Ultrasound pre-treatment of waste activated sludge," Water Sci. Tech., 6:35-42 (2006).
B. Bothner et al., "Electrospray ionization of a whole virus: analyzing mass, structure, and viability," ChemBioChem 5:258-60 (2004).
B. D. Storey and A. J. Szeri, "Water vapour, sonoluminescence and sonochemistry," Proc. Roy. Soc. Lond. A, 456:1685-1709 (2000).
C. Wu et al., "Ultrasound Ionization Mass Spectrometry(UI-MS) for Biomolecule Analysis," Poster presentation, 56th ASMS Conference on Mass Spectrometry and Allied Topics, Jun. 1-Jun. 5, 2008; Denver, Colorado.
C. Y. Hampton et al., "Analytical Performance of a Venturi-Assisted Array of Micromachined Ultrasonic Electrosprays Coupled to Ion Trap Mass Spectrometry for the Analysis of Peptides and Proteins," Anal. Chem., 79:8154-8161 (2007).
D. L. Tabb et al., "DTASelect and Contrast: Tools for Assembling and Comparing Protein Identifications from Shotgun Proteomics," J. Proteome Res., 1:21-26 (2002).
D. Shapira and M. Saltmarsh, "Nuclear Fusion in Collapsing Bubbles—Is It There? An Attempt to Repeat the Observation of Nuclear Emissions from Sonoluminescence," Phys. Rev. Lett., 89:104302-1-104302-4 (2002).
E. de Hoffmann and V. Stroobant, Mass Spectrometry: Principles and Applications, Chapters 1-3, 3rd Ed., John Wiley & Sons Inc., 2007.
J. F. Banks et al., "Ultrasonically Assisted Electrospray Ionization for LC/MS Determination of Nucleosides from a Transfer RNA Digest," Anal. Chem., 66:406-414 (1994).
F. Caupin and E. Herbert, "Cavitation in water: a review," C. R. Physique, 7:1000-1017 (2006).
G. Siuzdak, The Expanding Role of Mass Spectrometry in Biotechnology, 2nd Ed. MCC Press, San Diego. Chapters 1-2 (2006).
J. C. Schultz et al, "Mass determination of megadalton—DNA electrospray ions using charge-detection mass spectrometry," J. Am. Soc. Mass Spectrom. 9:305-313 (1998).
J. L. Campbell et al., "Analysis of polyethylene by using cyclopentadienyl cobalt chemical ionization combined with laser-induced acoustic desorption/fourier transform ion cyclotron resonance mass spectrometry," Anal. Chem. 77:4020-6 (2005).
J. L. Jimenez et al., "Ambient aerosol sampling using the Aerodyne aerosol mass spectrometer," J. Geophys. Res. Atmos. 108:8425-37 (2003).
J. R. Lindner, "Microbubbles in medical imaging: current applications and future directions," Nature Review Drug Discov., 3:527-532 (2004).
J. S. Gardner et al., "Sonic spray ionization mass spectrometry: a powerful tool used to characterize fragile metal-assembled cages," New J. Chem., 30:1276-1282 (2006).
J. Somuramasami et al., "Evaluation of a Novel Approach for Peptide Sequencing: Laser-Induced Acoustic Desorption Combined with $P(OCH_3)_2$* Chemical Ionization and Collision-activated Dissociation in a Fourier Transform Ion Cyclotron Resonance Mass Spectrometer," J Am Soc Mass Spectrom. 18:525-40. (Mar. 2007) (Epub Dec. 6, 2006).
K.-M. Lue et al., "Quadrupole mass spectrometer measurements of electrostatic sprays," Inst. Phys. Conf. Series 85: 337-342 (1987).
K. Tanaka et al., "Protein and polymer analyses up to m/z 100 000 by laser ionization time-of-flight mass spectrometry," Rapid Commun. Mass Spectrom. 2: 151-153 (1988).
L. Salsac et al., "Glow Discharges: Glow Discharges in low-pressure gases," SARL Atout & Progrés, Paris, France (Parts first published Oct. 17, 2006, and Sep. 12, 2007).
M. A. Meetani et al., "Desorption electrospray ionization mass spectrometry of intact bacteria," Journal of Mass Spectrometry, 42:1186-1193 (2007).
M. A. Tito et al., "Electrospray time-of-flight mass spectrometry of the intact MS2 virus capsid," J. Am. Chem. Soc. 122: 3550-51 (2000).
M. Huang et al., "Sonic Spray Nebulizer for Inductively Coupled Plasma Atomic Emission Spectrometry," Anal. Sciences, 15:265-268 (1999).
M. Karas et al., "Laser desorption ionization of proteins with molecular masses exceeding 10,000 Daltons," Anal. Chem., 60:2299-301 (1988).
M. Karas et al,, "Matrix-Assisted Ultraviolet Laser Desorption of Non-Volatile Compounds," Int. J. Mass Spectrom. Ion. Proc., 78:53-68 (1987).
M. Makowski et al., "Ab initio study of the energetic of protonation, deprotonation and homocomplexed cations and anions formulation in systems modeling side chains of biomolecules," J. Mol. Struct.: Theochem, 674:61-67 (2004).
M. T. Ngyuen et al., "Protonation and deprotonation energies of uracil Implications for the uracil-water complex," J. Chem. Soc. Faraday Trans., 94:1277-1280 (1998).
M. W. A. Kuijpers et al., "Cavitation-Induced Reactions in High-Pressure Carbon Dioxide," Science, 298:1969-1971 (2002).
P. R. Gogate and A. B. Pandit, "A review and assessment of hydrodynamic cavitation as a technology for the future," Utrasonic Sonochemistry, 12:21-27 (2005).
P. W. Geno et al., "Secondary electron emission induced by impact of low-velocity molecular ions on a microchannel plate," Int. J. Mass Spectrom. Ion Processes 92:195-210 (1989).
R. C. Shea et al., "Characterization of laser-induced acoustic desorption coupled with a fourier transform ion cyclotron resonance mass spectrometer," Anal. Chem. 78:6133-9 (2006).
R. Chen et al., "Trapping, detection, and mass determination of coliphage T4 DNA ions of $10^8$ Da by electrospray ionization fourier transform ion cyclotron resonance mass spectrometry", Anal. Chem. 67: 1159-1163 (1995).
R. G. Cooks et al., "Ambient Mass Spectrometry," Science 311:1566-1570 (2006).
R. Haddad et al., "Desorption sonic spray ionization for (high) voltage-free ambient mass spectrometry," Rapid Comm. Mass Spectrom., 20:2901-2905 (2006).
R. P. Taleyarkhan et al., "Nuclear Emissions During Self-Nucleated Acoustic Cavitation," Phys. Rev. Lett., 96:034301-1-034301-4 (2006).
R. P. Taleyarkhan et al., "Additional evidence of nuclear emissions during acoustic cavitation," Phys. Rev. E., 69:036109-1-036109-11 (2004).
R. P. Taleyarkhan et al., "Evidence for Nuclear Emissions During Acoustic Cavitation," Science, 295:1868-1873 (2002).
R. Redmer, "Physical properties of dense, low-temperature plasmas," Phys. Reports, 282:35-157 (1997).
S. Aderogba et al., "Nanoelectrospray ion generation for high-throughput mass spectrometry using a micromachined ultrasonic ejector array," Appl. Phys. Lett., 86:203110-1-203110-3 (2005).
S. Berkenkamp et al., "Infrared MALDI Mass Spectrometry of Large Nucleic Acids," Science, 281:260-262 (1998).
S. D. Fuerstenau et al., "Mass Spectrometry of an intact virus," Angew Chem Int Ed Engl. 40: 542-544 (2001); Corrigendum: Angew. Chem. Int. Ed. 40: 982 (2001) (refers to pp. 541-544).
S. F. Wong et al., "Multiple charging in electrospray ionization of poly(ethylene glycols)," J. Phys. Chem. 92:546-50 (1988).
S. Oie et al., "Microbial contamination of ambient air by ultrasonic humidifier and preventative measures," Microbios, 72:161-166 (1992).
S.D. Fuerstenau et al., "Molecular weight determination of mega-Dalton electrospray ions using charge detection time-of-flight mass spectrometry," Rapid Comm. Mass Spectrom., 9:1528-1538 (1995).
S.D. Fuerstenau, "Whole Virus Mass Analysis by Electrospray Ionization," J. Mass. Spectrom. Soc. Japan., 51:50-53 (2003).
V. V. Golovlev et al., "Laser-induced acoustic desorption of electrons and ions", Appl. Phys. Lett. 71: 852-854 (1997).
V. V. Golovlev et al., "Laser-induced acoustic desorption," Int. J. Mass Spectrom. Ion Processes 169/170: 69-78 (1997).
V. V. Golovlev, S.-S. H. Lee, S. L. Allman, N. I. Taranenko, and C. H. Chen, "Nonresonant MALDI of Oligonucleotides: Mechanism of Ion Desorption," Anal. Chem., 73:809-812 (2001).
W. Aberth et al., "Secondary ion mass spectrometry with cesium ion primary beam and liquid target matrix for analysis of bioorganic compounds," Anal. Chem. 54:2029-2034 (1982).

W. J. Henzel et al.; "Identifying proteins from two-dimensional gels by molecular mass searching of peptide fragments in protein sequence databases," Proc. Natl. Acad. Sci. USA 90:5011-5015 (1993).
W.-P. Peng et al., "Charge Monitoring Cell Mass Spectrometry," Analytical Chemistry, 80(7): 2524-2530 (2008).
W.-P. Peng et al., "Charge-Monitoring Laser-Induced Acoustic Desorption Mass Spectrometry for Cell and Microparticle Mass Distribution Measurement," Angew. Chem. Int. Ed., 46:3865-3869 (2007).
W.-P. Peng et al., "Laser-Induced Acoustic Desorption Mass Spectrometry of Single Bioparticles," Angewandte Chemie Int. Ed., 45:1423-1426 (2006).
W.-P. Peng et al., "Molar mass and molar mass distribution of polystyrene particle size standards," Anal. Chem., 77: 7084-7089 (2005).
Y. Cai et al., "Ion trap mass spectrometry of fluorescently labeled nanoparticles," Anal. Chem. 75:1805-11 (2003).
Y. Hirabayashi and A. Hirabayashi, "Capillary Isoelectric Focusing Separation Combined with Mass Spectrometry Using Sonic Spray Ionization for Protein Analysis," J. Mass. Spectrom. Soc. Jpn., 50:21-23 (2002).
Y. T. Didenko and K. S. Suslick, "The energy efficiency of formation of photons, radicals and ions during single-bubble cavitation," Nature, 418:394-397 (2002).
Z. Nie et al., "Microscopy-based mass measurement of a single whole virus in a cylindrical ion trap," Angew. Chem., 118:8311-8314 (2006).
Z. Takats et al., "Electrosonic Spray Ionization. A Gentle Technique for Generating Folded Proteins and Protein Complexes in the Gas Phase and for Studying Ion-Molecule Reactions at Atmospheric Pressure," Anal. Chem., 76:4050-4058 (2004).
Z. Takats et al., "Amino Acid Clusters Formed by Sonic Spray Ionization," Anal. Chem., 75:1514-1523 (2003).

* cited by examiner

ULTRASOUND IONIZATION MASS SPECTROMETER

This invention relates to the field of mass spectrometry, in particular, mass spectrometry involving ultrasound ionization.

Mass spectrometry generally involves obtaining analyte in an ionized state. Techniques used to achieve this step include Electron Ionization (EI), Chemical Ionization (CI), Field Ionization (FI), Fast Atom Bombardment (FAB), Ion Attachment Ionization (IA), Electrospray (ES), Thermospray (TS), Atmospheric Pressure Ionization (API), Atmospheric Pressure Photoionization (APP), Atmospheric Pressure Chemical Ionization (APCI), Direct Analysis in Real Time (DART), Surface-Enhanced Laser Desorption Ionization (SELDI), Desorption-Ionization On Silicon (DIOS), Desorption Electrospray Ionization (DESI), Plasma Desorption, Field Desorption (FD), Laser-Induced Acoustic Desorption (LIAD), and/or Matrix-Assisted Laser Desorption Ionization (MALDI). See, e.g., E. de Hoffmann and V. Stroobant, Mass Spectrometry: Principles and Applications (3rd Ed., John Wiley & Sons Inc., 2007).

Mass spectrometers thus can comprise an ionization source that operates by one or more of these techniques. The components of these ionization sources can include one or more lasers; desorption plates; electron sources; chemical ionization gas chambers; probe wires; emitter filament/counter-electrode pairs; fast atom bombardment guns; field desorption filaments (e.g., made of tungsten or rhenium and covered with carbon microneedles); plasma desorption foils (e.g., made of aluminized nylon); heating capillaries connected to a vacuum chamber containing a pusher and exit port that can be set at opposite electrical potentials; counter-electrodes and capillaries connected to a high voltage (e.g., 3-6 kV) source; electrical discharge sources in atmospheric pressure chambers; lamps capable of emitting photoionizing light (e.g., ultraviolet light); and/or gas sources, multiple electrodes, and heating elements (e.g., as in a DART source). See, e.g., E. de Hoffmann and V. Stroobant, Mass Spectrometry: Principles and Applications (3rd Ed., John Wiley & Sons Inc., 2007).

Mass spectrometric analysis of biomolecules frequently involves either matrix-assisted laser desorption/ionization (MALDI) or electrospray ionization (ESI). Development of MALDI (M. Karas et al., Int. J. Mass Spectrom. Ion. Proc. 78:53 (1987); K. Tanaka et al., Rapid Comm. Mass Spectrom 2:151 (1988); M. Karas et al., Anal. Chem. 60:2299 (1988); S. Berkenkamp et al., Science 281:260 (1998)) and ESI (S. F. Wong et al., J. Phys. Chem. 92:546 (1988); W. J. Henzel et al., Proc. Natl. Acad. Sci. USA 90:5011 (1993)) facilitated the analysis of biomolecules, organic polymers and proteomes by mass spectrometry (D. L. Tabb et al., J. Proteome Res. 1:21 (2002)). In addition to MALDI and ESI, laser-induced acoustic desorption (LIAD) was also developed for biomolecule and cell detection (V. V Golovlev et al., Intl. J. Mass Spectrom. Ion Proc. 169/170:69 (1997); V. V. Golovlev et al., Anal. Chem. 73:809 (2001); W. P. Peng et al., Angew. Chem. Int. 45:1423 (2006); W. P. Peng et al., Angew. Chem. Int. 46:3865 (2007)). LIAD was also applied to molecular detections with subsequent ionization processes (J. L. Campbell et al., Anal. Chem. 77:4020 (2005)). Sonic spray ionization (SSI) is another molecular ionization technique (J. L. Campbell et al., Anal. Chem. 77:4020 (2005); F. Banks et al., Anal. Chem. 66:406 (1994); A. Hirabayashi et al., Anal. Chem. 10:1703 (1996); M. Huang et al., Anal. Science 15:265 (1999); Y. Hirabayashi et al., J. Mass. Spectrom. Soc. Jpn. 50:21 (2002); Z. Takats et al., Anal. Chem. 75:1514 (2003); J. S. Gardner et al., New J. Chem. 30:1276 (2006)). SSI can involve spraying a solution from a capillary with a sonic gas flow coaxial to the capillary. Hirabayashi et. al proposed an explanation of charged droplet formation from SSI based on the non-uniformity of positive and negative ion concentration distribution near the solution surface (A. Hirabayashi et al., Anal. Chem. 67:2878 (1995); A. Hirabayashi, J. Mass Spectrom. Soc. Jpn. 47:289 (1999)). This may indicate that nonpolar compounds such as benzene may not be ionized efficiently by SSI. Electrosonic spray ionization (ESSI) with a traditional ESI with supersonic nebulizing gas has been applied to the study of protein folding (Z. Takats et al., Anal. Chem. 76:4050 (2004)). Desorption sonic spray ionization (DeSSI) which couples SSI and desorption electrospray ionization (DESI) (R. G. Cooks et al., Science 311:1566 (2006)) to produce ionization of solid analyte has also been reported (R. Haddad et al., Rapid Comm. Mass Spectrom. 20:2901 (2006)).

The instant invention concerns methods of mass spectrometry employing ultrasound ionization and apparatuses configured for such uses. These methods and apparatuses can have advantages such as, for example, broad analyte compatibility, ionization efficiency, reproducibility, low data complexity, and/or low cost of equipment. Neither a laser nor a high voltage on a capillary tip or spray source is required for ultrasound ionization.

Ultrasound has been broadly used for medical imaging for disease diagnosis and therapeutic applications (A. L. Klibanov, Adv. Drug Deliv. Rev. 37:139 (1999); J. R. Lindner, Nature Review Drug Discov. 3:527 (2004); A. M. Takalkar et al., J. Contr. Release 96:473 (2004)). In addition, ultrasound has been successfully used for various industrial applications such as sound navigation and ranging (SONAR), ultrasound cleaning, ultrasound-induced chemical reactions (sonochemistry), and humidity control (ultrasonic dehumidifier) (J. van Leeuwen et al., Water Sci. Tech 6:35 (2006); S. Oie et al., Microbios 72:292 (1992)). Ultrasound has also been used to eject charged droplets from micromachined array devices (S. Aderogba et al., Appl. Phys. Lett. 86:203110 (2005); C. Y. Hampton et al., Anal. Chem. 79:8154 (2007)) and in the extraction of lipid for chromatographic analysis (M. Mecozzi et al., J. Chromatography, 963:363 (2002)). Many of these processes involve cavitation. Cavitation, or a collapse of microscopic bubbles, can promote chemical reactions (M. W. A. Kuijpers et al., Science 298:1969 (2002)) and ionization. Cavitation can be produced through disruption of the liquid by rarefaction.

During the bubble burst processes of cavitation, short bursts of light known as sonoluminescence may occur. The possibility of nuclear fusion being promoted or induced by bubble burst sonoluminescence has been suggested in the literature (R. D. Taleyarkhan et al., Science 295:1868 (2002); D. Shapira et al., Phys. Rev. Lett. 89:104302 (2002); R. P. Taleyarkhan et al., Phys. Rev. E. 69:036109 (2004); R. P. Taleyarkhan et al., Phys. Rev. Lett. 96:034301 (2006)), although these reports appear to be controversial. These reports suggested that sonoluminescing systems may reach local temperatures exceeding 100,000 K or even 1,000,000 K and that such temperatures could result in thermonuclear fusion reactions. However, Flannigan and Suslick (Y. T. Didenko et al., Nature 418:394 (2002)) reported the observation of plasma by detecting ion production due to the collision of high energy electrons during single-bubble sonoluminescence. They concluded that the temperature during cavitation of acetone should be limited by endothermic chemical reactions inside the bubble. Kuijpers et al. (M. W. A. Kuijpers et al., Science 298:1969 (2002)) reported cavitation-induced reactions in high pressure carbon dioxide to yield organic polymers with high molecular weight. Storey and Szeri (B. D.

Storey et al., Proc. Roy. Soc. Lond. A, 456:1685 (2000)) estimated the theoretical temperature inside of the bubble as about 7,000 K, which is not expected to be sufficient to cause significant ionization of small molecules, such as $O_2$ and NO.

In this work, ultrasound is disclosed as an efficient method for ionization. In some embodiments, the invention provides a method of performing ultrasound ionization mass spectrometry comprising providing a sample comprising at least one analyte or analyte precursor in a dissolved, colloidal, suspended, or liquid state; subjecting the sample to ultrasound, wherein the ultrasound causes formation of an amount of ionized analyte detectable by mass spectrometry from the at least one analyte or analyte precursor; sorting or selecting the ionized analyte according to its mass to charge (m/z) ratio; and detecting the ionized analyte. In some embodiments, the method consists essentially of the foregoing steps.

In some embodiments, the invention provides an apparatus comprising an ultrasound source; a mass analyzer; and a detector, wherein the apparatus can ionize an analyte by ultrasound ionization to produce ionized analyte in a quantity sufficient for mass spectrometric analysis.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
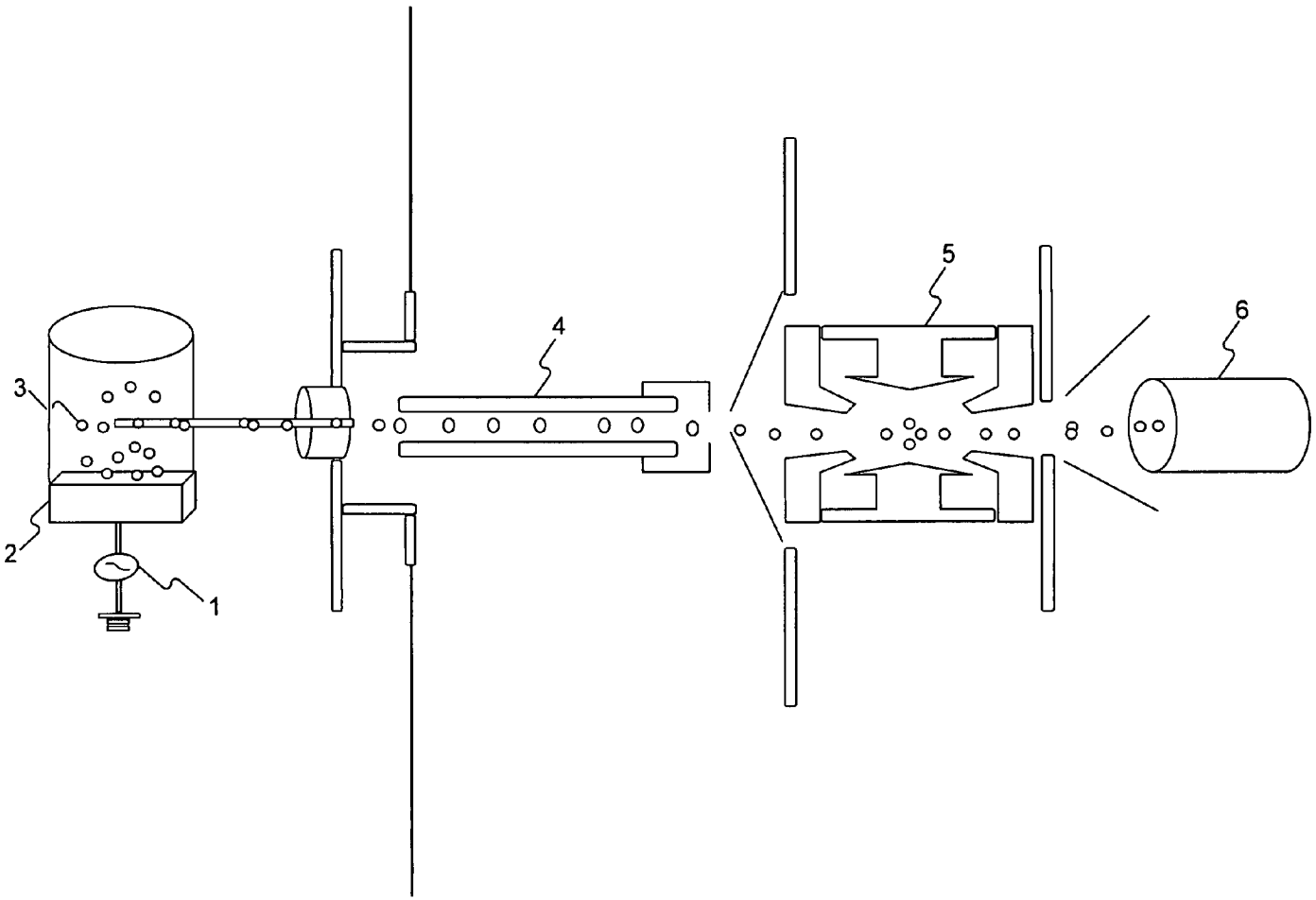
FIG. 1. Experimental schematic of an ultrasound ionization mass spectrometer. Shown is a schematic diagram of an embodiment of an apparatus of the invention in use. The apparatus comprises a piezoelectric transducer 2 connected to a sinusoidal drive 1 that can subject analyte 3 in a sample to ultrasound; a series of capillaries that draw ionized analyte from the sample, including a heating capillary 4; an ion trap mass analyzer 5; and a detector.

Reference will now be made in detail to embodiments of the invention, examples of which are illustrated in the accompanying drawings.

Methods

The invention relates to methods comprising subjecting an analyte or analyte precursor to ultrasound, wherein the ultrasound causes formation of an amount of ionized analyte detectable by mass spectrometry, and performing mass spectrometry on the ionized analyte. In some embodiments, the method comprises ionizing the analyte or analyte precursor, wherein the ionizing consists essentially of subjecting the analyte or analyte precursor to ultrasound. Performing mass spectrometry can comprise sorting or selecting the analyte according to its mass to charge (m/z) ratio, and detecting the analyte. Sorting or selecting the analyte according to its mass to charge (m/z) ratio can be performed by a mass analyzer, and detecting the analyte can be performed by a detector. Any operational combination of mass analyzer and detector can be used to perform mass spectrometry according to the invention. In some embodiments, performing mass spectrometry additionally comprises desolvating the analyte. This can be achieved, for example, thermally. Thermal desolvation can be achieved, for example, by using a heating capillary.

Analyte or Analyte Precursor

The invention relates to methods comprising providing at least one analyte or analyte precursor. An analyte is ionized prior to being subjected to downstream steps of mass spectrometry; an analyte precursor undergoes some change to its structure beyond ionization prior to being subjected to downstream steps of mass spectrometry. In some embodiments, an analyte precursor undergoes a change that results in the formation of ionized analyte; for example, an analyte precursor can decompose into at least two species, at least one of which is ionized. In some embodiments, the at least one analyte precursor can be converted to at least one analyte, and the at least one analyte can then be ionized. In some embodiments, the at least one analyte precursor can be ionized and then converted to analyte, which may retain the ionic character of the precursor and/or be ionized in an additional step.

In some embodiments, the at least one analyte or analyte precursor can be chosen from an organic molecule, inorganic molecule, macromolecule, macromolecular complex, oligonucleotide, nucleic acid, protein, polysaccharide, cell, virus, organelle, polymer, nanoparticle, microparticle, aerosol particle, and fine particulate object.

Dissolved, Colloidal, Suspended, or Liquid State

The at least one analyte or analyte precursor can be provided in a dissolved, colloidal, suspended, or liquid state. A sample containing the analyte or analyte precursor in a dissolved, colloidal, suspended, or liquid state can contain more than one solvent and/or additional compounds, as described below. In some embodiments, the at least one analyte or analyte precursor can be provided in a liquid state, wherein it is mixed with an additional liquid or liquids.

Concentration and Amount

The at least one analyte or analyte precursor can be provided at a concentration of 100 nM, 1 μM, 10 μM, 100 μM, 1 mM, or 10 mM, or more. The at least one analyte or analyte precursor can be provided in an amount of 100 fmol, 1 pmol, 10 pmol, 100 pmol, or 1000 pmol, or more.

Solvent Systems

In some embodiments, the at least one analyte or analyte precursor can be dissolved in a solvent system comprising multiple solvents. The solvents can comprise a mixture of organic solvents. The solvents can comprise water and a solvent less dense than water. The solvents can comprise water, at least one organic solvent, or a mixture thereof. In some embodiments, the organic components of the solvent system are water-miscible. In some embodiments, the solvent system comprises at least one organic solvent chosen from alcohols, ketones, esters, amides, amines, acids, aromatics, acetone, methanol, ethanol, isopropanol, n-propanol, butanone, any isomer of butanol, any isomer of pentanone, any isomer of pentanol, ethyl acetate, isopropyl acetate, methyl acetate, benzene, toluene, and phenol. Without wishing to be bound by any particular theory, the use of a solvent system comprising water and an organic solvent may result in the solution having properties that favor increased levels of ionization of the analyte by ultrasound, as compared to ionization in a solely water-based solvent system.

Acids and Bases

In some embodiments, at least one acid is added to or present in the sample. The at least one acid can be used to increase the level of ionized analyte produced according to the method of the invention. The at least one acid may promote ionization of the analyte by facilitating protonation while the sample is being subjected to ultrasound. In some embodiments, the at least one acid is a weak acid, having a $pK_a$ greater than one. In some embodiments, the at least one acid is chosen from at least one of 2,5-dihydroxybenzoic acid, trihydroxyacetophenone, α-cyano-4-hydroxycinnamic acid, picolinic acid, 3-hydroxypicolinic acid, trans-3-indoleacrylic acid, dithranol, and sinapinic acid. In some embodiments, the acid is present at a concentration of at least 100 nM, for example, at a concentration ranging from 100 nM to 10 mM, 1 μM to 1 mM, or 10 μM to 500 μM.

In some embodiments, at least one base is added to or present in the sample. The at least one base can be used to increase the level of ionized analyte produced according to the method of the invention. The at least one base may promote ionization of the analyte by facilitating deprotonation while the sample is being subjected to ultrasound. In some embodiments, the base is a weak base, having a $pK_b$ less than 13. Examples of weak bases include, without limitation, acetate salts, e.g., sodium acetate, potassium acetate, and ammonium acetate; ammonia; organic amines, e.g., triethylamine and trimethylamine; carboxylic acid salts; and conjugate bases of phenols, including substituted phenols. In some embodiments, the base is present at a concentration of at least 100 nM, for example, at a concentration ranging from 100 nM to 10 mM, 1 μM to 1 mM, or 10 μM to 500 μM.

Ultrasound

The invention relates to methods comprising subjecting a sample to ultrasound. Subjecting the sample to ultrasound results in ionization of analyte contained in the sample.

Power, Frequency, and Duration; Ionization and Sensitivity

The methods of the invention relate to subjecting the sample to ultrasound with a power, frequency, and duration effective to ionize the analyte or the analyte precursor. In some embodiments, the power of the ultrasound is at least 0.1 W, and can range from 0.1 W to 1000 W, for example, 1 W to 1000 W, 2 W to 1000 W, 1 W to 100 W, 2 W to 10 W, 2 W to 6 W, or about 4 W. In some embodiments, the frequency of the ultrasound can range from 10 kHz to 100 MHz, for example, 100 kHz to 10 MHz, 1 MHz to 3 MHz, or about 1.7 MHz. In some embodiments, the duration for which the sample is subjected to ultrasound is a time period of at least 1 millisecond, at least 10 milliseconds, at least 100 milliseconds, or at least 500 milliseconds. The duration can be a time period ranging from 1 ms to 1 minute; 10 ms to 30 s; 100 ms to 10 s; or 500 ms to 10 s.

Source

Any ultrasound source capable of delivering the appropriate frequency and power of ultrasound into the sample can be used in accordance with the methods of the invention. In some embodiments, a piezoelectric transducer, metal plate capable of vibration at ultrasonic frequency, or sonicator probe can be used as the ultrasound source. In some embodiments, ultrasound can be applied to sample contained in a capillary.

Cavitation

In some embodiments, subjecting the sample to ultrasound results in cavitation of the sample. Cavitation, in which the formation of transient bubbles is induced by ultrasound, results in high energy densities, temperatures, and pressures for short times at bubble surfaces. Without wishing to be bound by any particular theory, it is thought that cavitation and the localized high energy density it produces may facilitate and/or be important step in the mechanism of ultrasound ionization. Cavitation can be observed visually as the appearance and bursting of small bubbles in the sample.

Induction of Reactions; Sonoluminescence

In some embodiments, at least one analyte precursor is provided in the sample, and subjecting the sample to ultrasound results in a reaction that converts the at least one analyte precursor into at least one analyte. See, e.g., P. R. Gogate et al., Ultrasonics Sonochemistry 12:21 (2005); F. Caupin et al., C. R. Physique 7:1000 (2006)). The reaction may or may not be separate from the process of ionization, as described above (see "Analyte or analyte precursor" section). The analyte can then be detected mass spectrometrically. In some embodiments, the reaction is induced by cavitation.

In some embodiments, subjecting the sample to ultrasound can result in sonoluminescence, in which some of the energy present at cavitating bubble surfaces is emitted in the form of light. Ultrasound with a power of at least 1 W is generally needed to produce sonoluminescence.

Desolvation

In some embodiments, the analyte is desolvated. Desolvation can occur after the analyte has been ionized and before the analyte enters the mass analyzer. Desolvation can occur by thermal desolvation, which can be achieved using a heating capillary at a temperature of, e.g., 180° C.

In some embodiments, the methods of the invention do not comprise any step other than ultrasound ionization that ionizes the analyte. In certain embodiments of the methods of the invention, ultrasound causes at least 10%, 25%, 50%, 60%, 70%, 80%, 90%, 95%, 98%, or 99% of the total amount of ionization that occurs, according to the weight or the molar amount of ionized analyte produced.

Apparatus

The invention relates to an apparatus comprising an ultrasound source, a mass analyzer, and a detector, so that the apparatus is capable of performing ultrasound ionization mass spectrometry. The apparatus can be used in some of the method embodiments described above.

In some embodiments, the apparatus of the invention is capable of detecting analyte present in the sample at a concentration of at least 100 nM, 1 μM, or 10 μM. In some embodiments, the apparatus of the invention is capable of detecting analyte provided in an amount of at least 100 fmol, 1 pmol, 10 pmol, 100 pmol, or 1000 pmol.

In some embodiments, the apparatus can comprise at least one component that can desolvate the analyte, such as, for example, a heating capillary. In other embodiments, the apparatus does not comprise a specific desolvation component, for example, if the apparatus operates by a mechanism that does not produce solvated gas phase analyte, such as, e.g., nanospray.

Ultrasound Source

The invention relates to an apparatus comprising any type of ultrasound source that can deliver ultrasound into a sample so as to result in formation of ionized analyte. In some embodiments, the ultrasound source comprises a component chosen from a sonicator probe, a metal plate capable of vibration at ultrasonic frequency, and a piezoelectric transducer. In some embodiments, the apparatus can ionize analyte by ultrasound so that at least 10%, 25%, 50%, 60%, 70%, 80%, 90%, 95%, or 99% of the ionized analyte produced is ionized by ultrasound. In some embodiments, the apparatus does not comprise an ionization source, other than the ultrasound ionization source, that can ionize analyte in a quantity sufficient for mass spectrometric analysis, when the analyte is provided in an amount of 100 femtomoles.

Mass Analyzer

In certain embodiments, the invention relates to an apparatus comprising a mass analyzer. The mass analyzer can use an electromagnetic field to sort analytes in space or time according to their mass to charge ratio. The invention relates to mass spectrometers comprising any type of mass analyzer.

Ion Trap-Based Analyzer

In some embodiments, the analyte can be analyzed in an ion trap. This type of mass analyzer can subject the analyte to an electric field oscillating at a radio frequency (RF) and the electrodes of the trap can additionally have a DC bias, for example, of around 2000 V.

The ion trap can be a three-dimensional quadrupole ion trap, also known as a Paul Ion Trap, which can have end cap electrodes and a ring electrode. The end cap electrodes can be hyperbolic. The end cap electrodes can be ellipsoid. Holes can be drilled in the end cap electrodes through which analyte can be ejected and through which light scattering can be observed. The frequency of oscillation can be scanned to eject analyte from the trap according to its mass to charge ratio.

The ion trap can be a linear ion trap (LIT), also known as a two dimensional ion trap. The linear ion trap can have four rod electrodes. The rod electrodes can cause oscillation of analyte in the trap through application of an RF potential. An additional DC voltage can be applied to the end parts of the rod electrodes to repel analyte toward the middle of the trap. The linear ion trap can have end electrodes placed near the ends of the rod electrodes, and these end electrodes can be subject to a DC voltage to repel analyte toward the middle of the trap. Analyte can be ejected from the linear ion trap. Ejection can be accomplished axially using fringe field effects generated, for example, by an additional electrode near the trap. Ejection can be accomplished radially through slots cut in rod electrodes. The LIT can be coupled with more than one detector so as to detect analyte ejected axially and radially.

Time of Flight

In certain embodiments, the mass analyzer can be a time-of-flight analyzer. The time of flight analyzer can include electrodes to generate an electric field in one region to accelerate the analyte, followed by a field-free region, followed by a detector. The time of flight analyzer can be a reflectron time of flight analyzer, in which a reflectron or electrostatic reflector can increase the total flight length and time of the analyte. The time of flight analyzer can operate by delayed pulse extraction, in which the accelerating field is controlled in a manner to correct ion energy dispersion and/or is present only after a delay following absorption. The time of flight analyzer can operate by continuous extraction, in which the accelerating field is continuously present in its region during analysis.

Other Mass Analyzers

Additional mass analyzers that can be adapted for use with the invention include, without limitation, quadrupole, magnetic sector, orbitrap, and ion cyclotron resonance analyzers. See, e.g., G. Siuzdak, The Expanding Role of Mass Spectrometry in Biotechnology (2nd Ed., MCC Press, 2006); E. de Hoffmann and V. Stroobant, Mass Spectrometry: Principles and Applications (3rd Ed., John Wiley & Sons Inc., 2007). Other types of mass analyzers are also included in this invention.

Detector

In certain embodiments, the apparatus comprises a detector. In some embodiments, the detector is located adjacent to a mass analyzer so that it detects particles ejected by the mass analyzer. In some embodiments, the detector is integrated with the mass analyzer, as is typical in mass analyzers that detect analyte inductively, such as, for example, ion cyclotron resonance or orbitrap mass analyzers.

The detector can comprise a secondary electron amplification device such as, for example, a microchannel plate (MCP), a microsphere plate, an electromultiplier, or a channeltron. The detector can comprise a conversion dynode, which can be discrete or continuous. In some embodiments, the detector can comprise an energy detector device such as a superconducting cryogenic detector. In some embodiments, the detector operates by producing secondary ions, and/or by secondary electron ejection and amplification detection. In some embodiments, the detector comprises a component chosen from a Faraday cup or plate, an induction charge detector, an electro-optical ion detector, and a photographic plate. Other types of detectors compatible with mass spectrometry are also included within this invention.

EXAMPLES

Example 1

Ultrasound Ionization Mass Spectrometer

An ultrasound ionization mass spectrometer was constructed as follows. To produce ultrasound, a piezoelectric device (Eleceram Technology Co., Taiwan; Model: NUTD25F1630R-SB, electric power: 40 W) was provided. The output ultrasound power was monitored by a broad band probe hydrophone (RESON Inc., California, USA; Model: TC4038). A first capillary with an inner diameter of 1.15 mm, an outer diameter of 1.46 mm, and a length of 72.52 mm was provided to draw sample into a chamber containing a heating capillary and an ion trap mass analyzer as in FIG. 1. The mass analyzer was coupled to an electromultiplier detector.

Example 2

Ultrasound Ionization Mass Spectrometry of Various Samples

In separate experiments, angiotensin, insulin A, insulin B, and cholic acid were each dissolved in water at 1 nmol/μl. One to five microliters of the sample solution were placed on the surface of the piezoelectric device and subjected to ultrasound at approximately 4 W of power for less than 10 seconds. The ultrasound frequency was measured as 1.7 MHz using a broad band probe hydrophone.

Small droplets with an estimated size of 1 to 3 μm were produced. These small droplets were drawn by capillary action through the first capillary and introduced to the heating capillary, which was at a temperature of approximately 180° C. Neither exogenous gas bubbles nor voltage were applied to the sample or the capillary, respectively; therefore neither sonic spray nor electrospray ionization occurred. Under the conditions used to generate ions, cavitation was observed as the formation and bursting of bubbles within the sample. Analyte within the droplets was desolvated as it passed through the heating capillary. The desolvated analyte then entered the ion trap mass analyzer.

Figure 2:
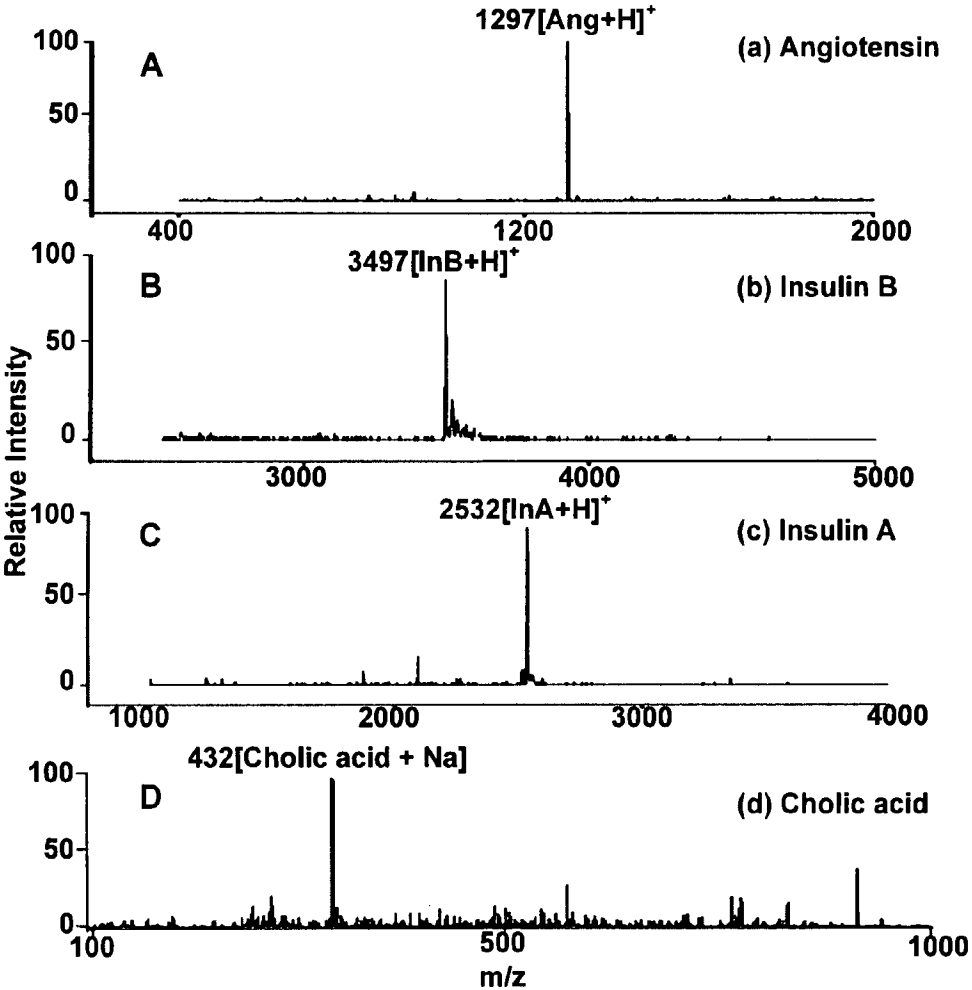
FIG. 2. Mass spectra of various samples dissolved in water, provided in the amount of 1000-5000 pmol, obtained by ultrasound ionization mass spectrometry. (A) The sample was angiotensin. (B) The sample was insulin B. (C) The sample was insulin A. (D) The sample was cholic acid.

Ultrasound ionization of proteins, saccharides, and lipids was successfully observed. Mass spectra of angiotensin, insulin A, insulin B, and cholic acid are shown in FIG. 2. Most observed ions in these experiments were singly charged. Therefore, the patterns of mass spectra obtained by ultrasound ionization were more similar to the spectra one would expect to obtain using MALDI ionization as opposed to electrospray ionization. With angiotensin, in separate experiments, both positive and negative peptide ions were observed.

The procedure was repeated but with either 1000, 2000, or 3000 volts applied at the first capillary. The mass spectra obtained did not have significant differences. This indicates that the ionization mechanism differed from ESI.

Figure 3:
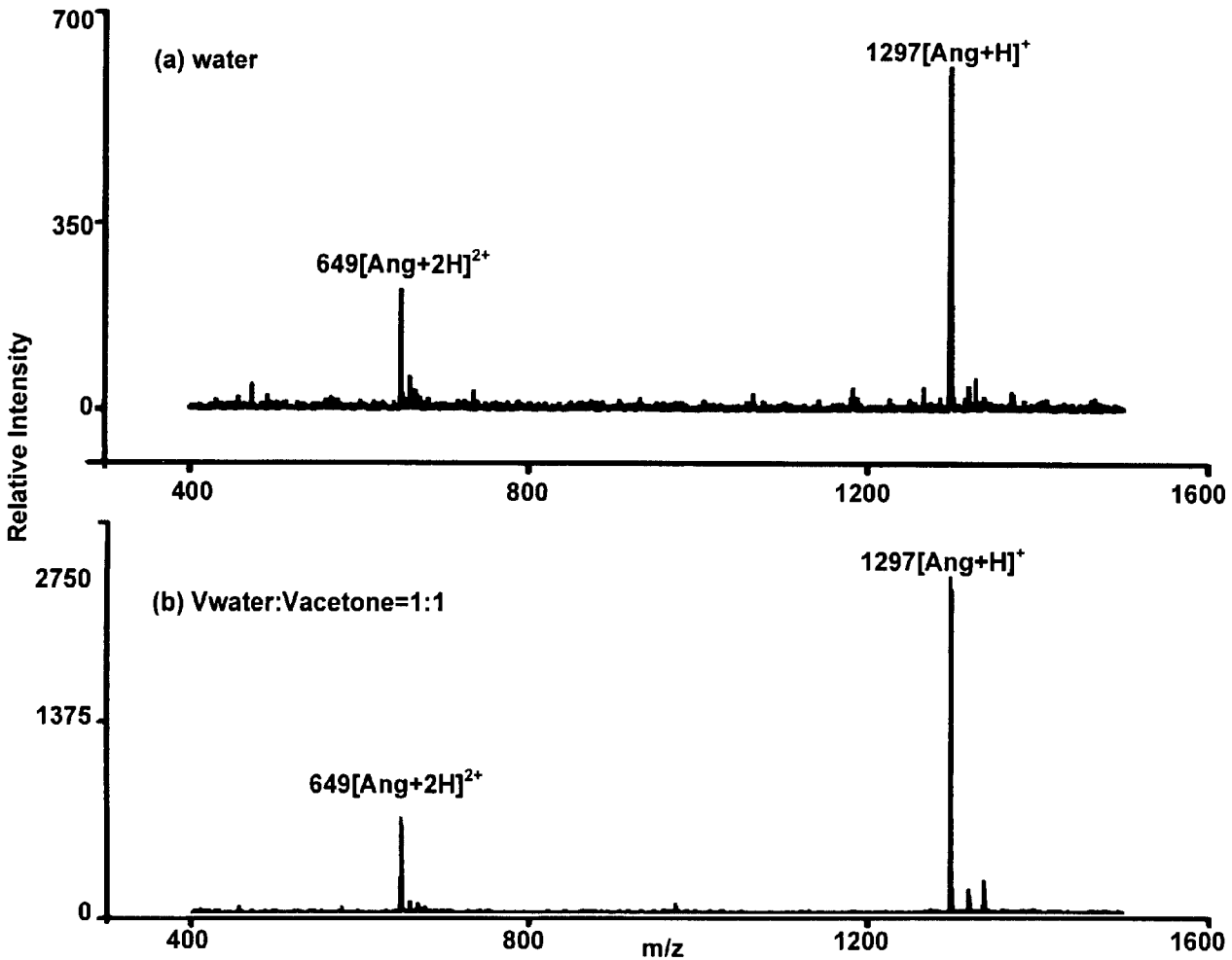
FIG. 3. Mass spectra of angiotensin obtained by ultrasound ionization mass spectrometry. Angiotensin was dissolved at 1000 pmol/μl in (A) distilled water or (B) a 1:1 mixture by volume of water and acetone.

Mass spectra of angiotensin were obtained using samples in water (FIG. 3A) or in a 1:1 mixture of water and acetone (FIG. 3B). The signal intensity, in terms of signal-to-noise ratio, was approximately a factor of four higher when the mixture of water and acetone was used.

Example 3

Figure 4:
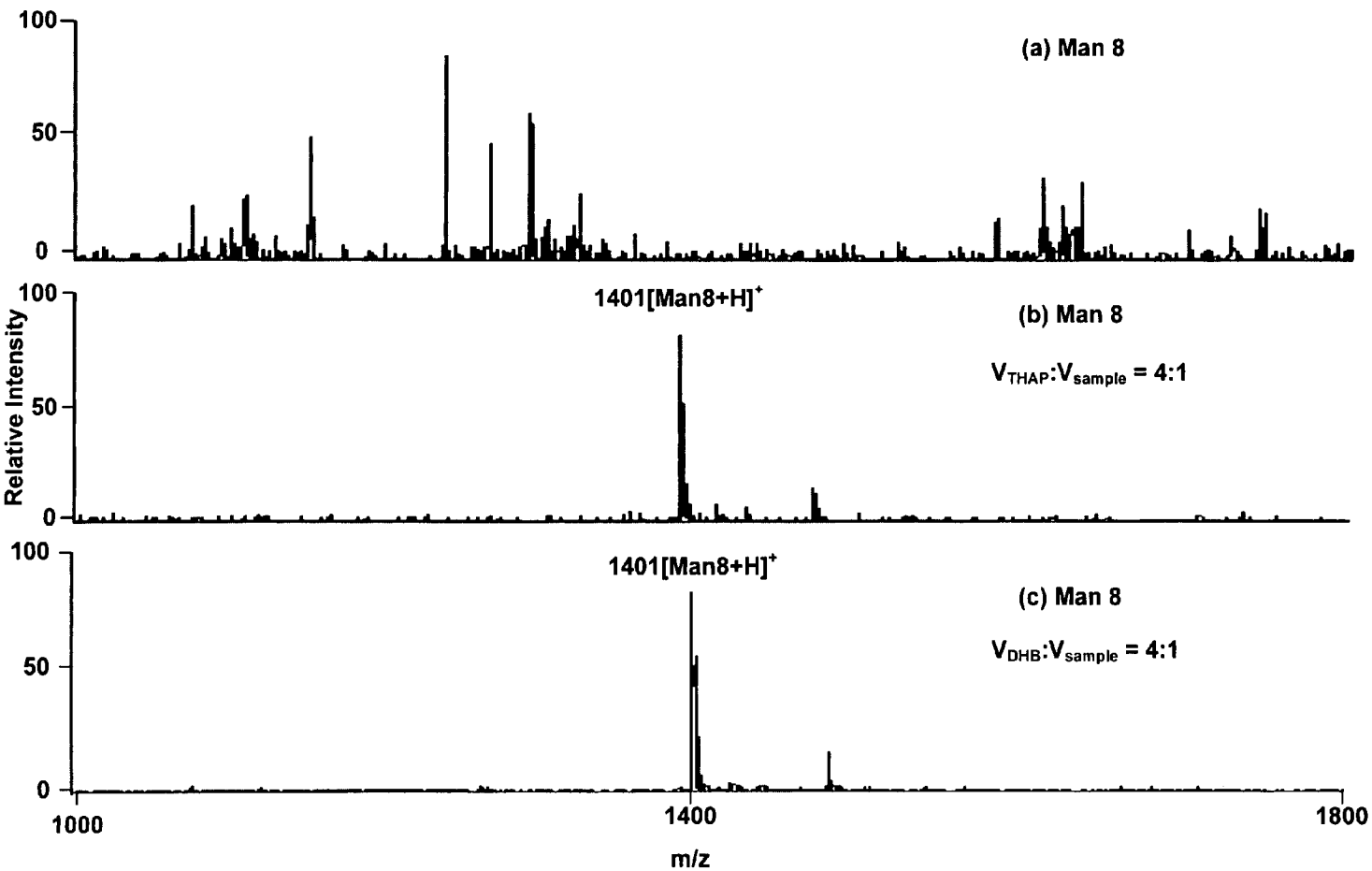
FIG. 4. Mass spectra of Man8 obtained by ultrasound ionization mass spectrometry. Man8 was dissolved at 1000 pmol/μL in various solutions and 1-5 μL was used to generate each spectrum. (A) The solvent was distilled water. (B) The solvent was 200 pmol/μL trihydroxyacetophenone in water. (C) The solvent was 200 pmol/μL 2,5-dihydroxybenzoic acid in water.

Ultrasound Ionization Mass Spectrometry of an Oligosaccharide With Protonating Agents Ultrasound ionization was also used for ionization of oligosaccharides. FIG. 4 shows the mass spectra of a mannose octamer (Man8), provided at 1000 pmol/μl, obtained by ultrasound ionization. No signal corresponding to Man8 molecular ions was observed when Man8 was provided in aqueous solution (FIG. 4A). When either 2,5-dihydroxybenzoic acid (DHB) or trihydroxyacetophenone (THAP) was added, protonated parent ions were observed. FIG. 4B shows the result of an experiment in which THAP was provided at 200 pmol/μl. FIG. 3C shows the result of an experiment in which DHB was provided at 200 pmol/μl. The molecular ions observed were mostly protonated ions. Analysis and interpretation of spectra obtained with protonated ions are generally simpler than with ions charged through alkali attachment.

DHB and THAP are commorily employed as matrices for proteins and oligosaccharides with MALDI ionization (E. de Hoffmann and V. Stroobant, Mass Spectrometry: Principles and Applications (3rd Ed., John Wiley & Sons Inc., 2007), Ch. 1). The enhanced ionization observed here may result from the acidity of these compounds, which may allow them to promote a protonation reaction during cavitation. However, use of either of two stronger acids, hydrochloric acid (HCl) and trifluoroacetic acid (TFA), did not result in detection of Man8 molecular ions.

The embodiments within the specification provide an illustration of embodiments of the invention and should not be construed to limit the scope of the invention. The skilled artisan readily recognizes that many other embodiments are encompassed by the invention. All publications and patents cited in this disclosure are incorporated by reference in their entirety. To the extent the material incorporated by reference contradicts or is inconsistent with this specification, the specification will supersede any such material. The citation of any references herein is not an admission that such references are prior art to the present invention.

Unless otherwise indicated, all numbers expressing quantities of ingredients, reaction conditions, and so forth used in the specification, including the claims, are to be understood as being modified in all instances by the term "about." Accordingly, unless otherwise indicated to the contrary, the numerical parameters are approximations and may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Unless otherwise indicated, the term "at least" preceding a series of elements is to be understood to refer to every element in the series. Those skilled in the art will recognize, or be able to ascertain using no more than routine experimentation, many equivalents to the specific embodiments of the invention described herein. Such equivalents are intended to be encompassed by the following claims.

A claimed embodiment that is recited as comprising certain components or steps and not comprising certain other component(s) or step(s) is understood to be open except for the excluded component(s) or step(s); that is, an apparatus or method comprising the excluded component(s) or step(s) would be outside the scope of the claimed embodiment in question.

What is claimed is:

1. A method for performing mass spectrometry comprising:

(a) providing a sample comprising at least one analyte or analyte precursor in a dissolved, colloidal, suspended, or liquid state in a multiple-solvent containing an ionization promoter;

(b) subjecting the sample in the multiple-solvent system to cavitation-producing ultrasound with a frequency ranging from about 1 MHz to about 3 MHz, wherein the ultrasound causes formation of an amount of ionized analyte detectable by mass spectrometry from the at least one analyte or analyte precursor;

(c) desolvating the ionized sample in a heated capillary;

(d) sorting or selecting the ionized analyte according to its mass to charge (m/z) ratio; and (e) detecting the ionized analyte.

2. The method of claim 1, wherein the method allows detection of analyte provided in an amount of 100 femtomoles.

3. The method of claim 1, wherein the multiple-solvent system is water and a solvent less dense than water.

4. The method of claim 1, wherein the multiple-solvent system is water and at least one organic solvent.

5. The method of claim 4, wherein the at least one organic solvent is chosen from water-miscible alcohols, ketones, esters, amides, amines, aromatics, and acids.

6. The method of claim 4, wherein the at least one organic solvent is chosen from methanol, ethanol, isopropanol, n-propanol, acetone, butanone, any isomer of butanol, any isomer of pentanone, any isomer of pentanol, ethyl acetate, isopropyl acetate, methyl acetate, benzene, toluene, and phenol.

7. The method of claim 1, wherein the multiple-solvent system is water and acetone.

8. The method of claim 1, wherein the ionization promoter is an acid.

9. The method of claim 1, wherein the ionization promoter is a weak acid present at a concentration greater than or equal to 100 nM.

10. The method of claim 9, wherein the weak acid is chosen from α-cyano4-hydroxycinnamic acid, 2,5-dihydroxybenzoic acid, sinapinic acid, trihydroxyacetophenone, picolinic acid, 3-hydroxypicolinic acid, trans-3-indoleacrylic acid, and dithranol.

11. The method of claim 9, wherein the acid is chosen from 2,5-dihydroxybenzoic acid and trihydroxyacetophenone.

12. The method of claim 1, wherein the ionization promoter is a base.

13. The method of claim 1, wherein the ionization promoter is a weak base present at a concentration greater than or equal to 100 nM.

14. The method of claim 13, wherein the weak base is chosen from conjugate bases of carboxylic acids; ammonia; organic amines; and conjugate bases of phenols and substituted phenols.

15. The method of claim 1, wherein the analyte or analyte precursor comprises at least one macromolecule, polymer, nanoparticle, or microparticle.

16. The method of claim 1, wherein the analyte or analyte precursor comprises at least one cell, virus, chromosome, or organelle.

17. The method of claim 1, wherein:

the multiple-solvent system is water and an organic solvent, and the ionization promoter is weak acid; and the sample is subjected to ultrasound with a power ranging from 2 W to 6 W for a time period ranging from 1 second to 10 seconds.

18. The method of claim 1, wherein the sample comprises at least one analyte precursor, and further wherein subjecting the sample to ultrasound converts the analyte precursor to an ionized analyte.

19. An apparatus comprising:

(a) an ultrasound source for generating ultrasounds in the range from 1 to 3 MHz;

(b) a heated capillary;

(c) a mass analyzer; and (d) a detector, wherein the apparatus can ionize an analyte or analyte precursor by ultrasound ionization to produce ionized analyte in a quantity sufficient for mass spectrometric analysis.

20. The apparatus of claim 19, wherein the apparatus can ionize analyte by ultrasound such that at least 10% of the ionized analyte produced is ionized by ultrasound.

21. The apparatus of claim 20, wherein the apparatus does not comprise a MALDI, electrospray, or sonic spray ionization source.

22. The apparatus of claim 20, wherein the apparatus does not comprise an ionization source, other than the ultrasound ionization source, that can ionize analyte provided in an amount of 100 femtomoles in a quantity sufficient for mass spectrometric analysis.

23. The apparatus of claim 20, wherein the mass analyzer is chosen from an ion trap mass analyzer, quadrupole ion trap mass analyzer, linear ion trap mass analyzer, time-of-flight mass analyzer, ion cyclotron resonance mass analyzer, magnetic mass analyzer, magnetic sector mass analyzer, electrostatic field mass analyzer, dual sector mass analyzer, quadrupole mass analyzer, and an orbitrap mass analyzer.

24. The apparatus of claim 20, wherein the detector comprises a charge detection plate or cup, induction charge detector, photographic plate, secondary electron amplification detector, channeltron, electromultiplier, microchannel plate, microchannel sphere, or superconducting cryogenic detector.

25. The apparatus of claim 20, wherein the ultrasound source comprises a piezoelectric transducer.

26. The apparatus of claim 20, wherein the ultrasound source comprises a sonicator probe or a metal plate capable of vibration of ultrasonic frequency.

* * * * *